US010218122B1

(12) United States Patent
Rengifo

(10) Patent No.: US 10,218,122 B1
(45) Date of Patent: Feb. 26, 2019

(54) CIRCULAR CONNECTOR AND METHOD OF RETAINING COMPONENTS

(71) Applicant: TE CONNECTIVITY CORPORATION, Berwyn, PA (US)

(72) Inventor: Alex Robert Rengifo, Oceanside, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/672,703

(22) Filed: Aug. 9, 2017

(51) Int. Cl.

| | |
|---|---|
| ***H01R 13/639*** | (2006.01) |
| *H01R 13/627* | (2006.01) |
| *H01R 33/97* | (2006.01) |
| *H01R 13/59* | (2006.01) |
| *H01R 33/96* | (2006.01) |
| *H01R 33/945* | (2006.01) |

(52) U.S. Cl.
CPC ..... *H01R 13/639* (2013.01); *H01R 13/59* (2013.01); *H01R 13/6273* (2013.01); *H01R 13/6275* (2013.01); *H01R 33/9453* (2013.01); *H01R 33/962* (2013.01); *H01R 33/973* (2013.01)

(58) Field of Classification Search
CPC ..... H01R 33/973; H01R 33/962; H01R 33/9453; H01R 13/59; H01R 13/6275; H01R 13/6273
USPC ..... 439/677, 680, 703–706, 584, 352
See application file for complete search history.

(56) References Cited

U.S. PATENT DOCUMENTS

| | | | | |
|---|---|---|---|---|
| 4,900,068 | A * | 2/1990 | Law | F16L 33/222 285/139.2 |
| 6,716,071 | B2 | 4/2004 | Miyazaki | |
| 6,966,788 | B1 | 11/2005 | Ruhl, Jr. | |
| 7,735,876 | B2 * | 6/2010 | Chiu | F16L 5/00 174/655 |
| 8,221,161 | B2 | 7/2012 | Leibfried, Jr. | |
| 8,563,876 | B1 * | 10/2013 | Gretz | H01R 13/59 174/541 |
| 8,708,732 | B2 * | 4/2014 | Toda | H01R 13/622 439/352 |
| 9,559,458 | B2 * | 1/2017 | Zhang | |
| 9,726,309 | B1 * | 8/2017 | Rowley | F16L 19/061 |
| 2016/0072221 | A1 | 3/2016 | Bates, III et al. | |

* cited by examiner

*Primary Examiner* — Tho D Ta
*Assistant Examiner* — Marcus Harcum

(57) ABSTRACT

A circular connector assembly having a plug shell, a coupling ring and a housing and a method of retaining the housing. The plug shell has a flexible insert-receiving retention portion and a flange provided proximate the flexible insert-receiving retention portion. The flexible insert-receiving retention portion has an insert-receiving opening. The coupling ring has an internal threaded portion and an engagement portion. The internal threaded portion is configured to cooperate with the flange. The engagement portion is dimensioned to resiliently deform the flexible insert-receiving retention portion when the engagement portion is provided in contact with the flexible insert-receiving retention portion. The insert is inserted into and maintained in the plug shell by the flexible insert-receiving retention portion.

14 Claims, 2 Drawing Sheets

CIRCULAR CONNECTOR AND METHOD OF RETAINING COMPONENTS

FIELD OF THE INVENTION

The present invention relates to a circular connector and a method for retaining components. In particular, the invention relates to a component of the circular connector which can be flexed to allow for insertion and removal of components.

BACKGROUND OF THE INVENTION

Circular connectors having multi-pin interconnects with cylindrical contact housings and circular contact interface geometries are well known in the industry. Circular connectors are used in various applications due to their ability to conveniently house different types of contacts, their wide range of allowable contact voltages and currents, their ease of environmental sealing and their rugged mechanical performance.

While existing connectors work relatively well, there is no easy or simple way to assemble or disassemble a circular connector, and consequently, they are time-consuming to install. To connect or disconnect conductors, the threaded nut must be engaged or disengaged before the connection may be made or broken. In addition, temperature cycling and/or rotational torque applied to the cable assembly can cause the threaded nut to back off, negatively impacting electrical and mechanical performance. In known circular connectors, the threaded nut and other components must be made of metal or the like, to ensure for reliability over many cycles, thereby adding to the cost of the connectors. Alternatively, metal snap rings may be required to maintain the components in positions. Such snap rings make it difficult to disassemble the components.

It would, therefore, be beneficial to provide a circular connector and method in which flexible retention features are used to maintain the components in position, allowing for the ease in the assembly and disassembly of the components.

SUMMARY OF THE INVENTION

An object is to provide a circular connector with a flexible or deformable retention member to retain components of the circular connector assembly in position.

An object is to provide a method which simplifies the method of retaining components of a circular connector assembly in position.

An embodiment is directed to a circular connector assembly having a plug shell, a coupling ring and an insert. The plug shell has a flexible insert-receiving retention portion and a flange provided proximate the flexible insert-receiving retention portion. The flexible insert-receiving retention portion has an insert-receiving opening. The coupling ring has an internal threaded portion and an engagement portion. The internal threaded portion is configured to cooperate with the flange. The engagement portion is dimensioned to resiliently deform the flexible insert-receiving retention portion when the engagement portion is provided in contact with the flexible insert-receiving retention portion. The insert which is inserted into and maintained in the plug shell by the flexible insert-receiving retention portion.

An embodiment is directed to a circular connector assembly with a receptacle shell and a plug shell. The receptacle shell has an externally threaded portion positioned proximate a first end of the receptacle shell and a first flexible receiving retention portion with a first receiving opening. The plug shell has a second flexible receiving retention portion and a flange provided proximate the second flexible receiving retention portion. The second flexible receiving retention portion having a second receiving opening. A coupling ring has an internal threaded portion and an engagement portion, with the internal threaded portion configured to cooperate with the flange and the externally threaded portion. The engagement portion is dimensioned to resiliently deform the second flexible receiving retention portion when the engagement portion is provided in contact with the second flexible insert-receiving retention portion. The circular connector assembly also includes a first housing and a second housing. The first housing is inserted into and maintained in the first receiving opening by the first flexible receiving retention portion. The second housing is inserted into and maintained in the second receiving opening by the second flexible receiving retention portion.

An embodiment is directed to a method for retaining components in a circular connector assembly, the method comprising: positioning a coupling ring on a plug shell of the circular connector assembly, the plug shell of the circular connector having a flexible retention portion which is initially configured to not allow insertion of a housing therein; moving the coupling ring from a first position to a second position in which the coupling ring engages the flexible retention portion of the plug shell; deforming the flexible retention portion of the plug shell as the coupling ring is moved to the second position to a configuration in which the flexible retention portion accepts the housing therein; returning the coupling ring to the first position; and allowing the flexible retention portion to return to an undeformed configuration as the coupling ring is moved to the first position, wherein the housing is retained in the flexible retention portion.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
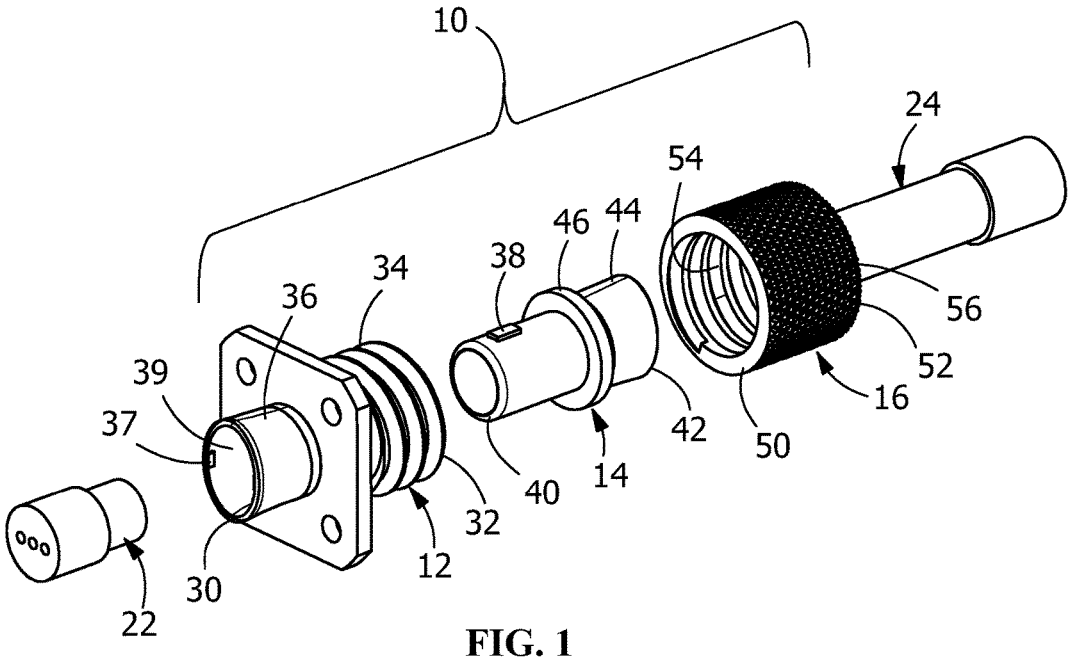
FIG. 1 is an exploded perspective view of an illustrative circular connector assembly having flexible retention portions according to the present invention.
Figure 2:
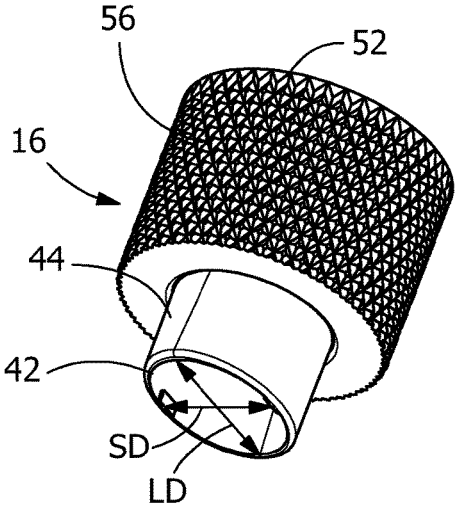
FIG. 2 is an enlarged perspective view of a plug shell of the circular connector assembly of FIG. 1, illustrating a coupling ring proximate a first flexible retention portion.
Figure 3:
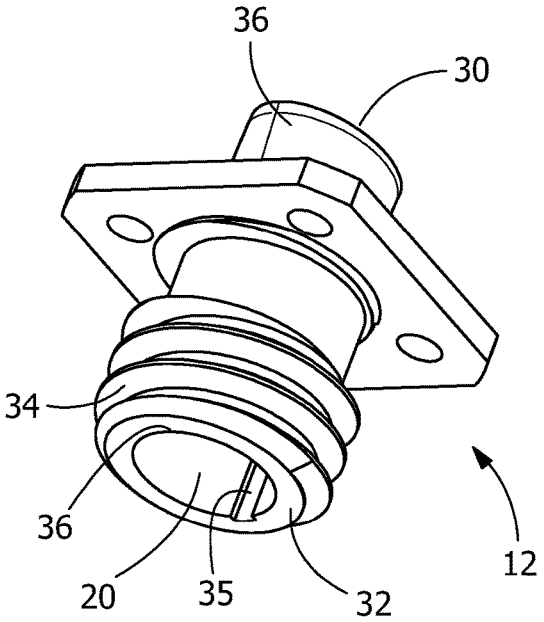
FIG. 3 is an enlarged perspective view of a receptacle shell of the circular connector assembly of FIG. 1, illustrating a second flexible retention portion.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Certain exemplary embodiments will now be described to provide an overall understanding of the principles of the structure, function, manufacture and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

An exemplary embodiment of a circular connector assembly 10 and various components thereof are best shown in FIG. 1. The circular connector assembly 10 includes a receptacle shell 12, a plug shell 14 and a coupling ring 16. Accordingly, the receptacle shell 12 includes an opening 20 that is structured and dimensioned to receive the plug shell 14 therein.

In the illustrative embodiment shown, the receptacle shell 12 and the plug shell 14 can each include an insert with electrical contacts housed therein. For example, the receptacle shell 12 can include a receptacle shell housing or insert 22 with at least one contact (not shown) housed therein, and the plug shell 14 can include a plug shell insert 24 with at least one contact (not shown) housed therein. When fully assembled, the circular connector assembly 10 can physically connect and electrically couple the contact(s) housed within the insert 24 of the plug shell 14 to the contact(s) housed within the receptacle shell housing or insert 22 of the receptacle shell 12.

The receptacle shell 12 has a first end 30 and a second end 32. The externally threaded portion or external threads 34 of the receptacle shell 12 are positioned at and/or near the second end 32. An attachment portion or flexible receptacle shell insert-receiving retention portion 36 is positioned at and/or near the first end 30. The attachment portion or flexible insert-receiving retention portion 36 is configured to attach the receptacle shell 12 to the receptacle shell housing 22, as will be more fully described. One or more retention projections 37 extend into an insert-receiving opening 39.

In various embodiments, the receptacle shell 12 may include at least one alignment member 35 which extends from at and/or near the second end 32 toward the first end 30. The alignment feature(s) can be structured, dimensioned and/or positioned to mate with corresponding alignment member(s) 38 on the plug shell 14. Mating engagement between the alignment members can guide and/or facilitate axial connection of the receptacle shell 12 and the plug shell 14. For example, each alignment member 35 of the receptacle shell 12 can include at least one longitudinal and/or axially extending groove and the alignment projection or member 38 of the plug shell 14 can include at least one longitudinal and/or axially extending rib. The grooves can slidably receive the ribs to connect the receptacle shell 12 and the plug shell 14 and can also prevent rotation between the receptacle shell 12 and the plug shell 14.

Additionally or alternatively, various styles and/or arrangements of alignment members can be utilized to prevent rotation between the receptacle shell 12 and the plug shell 14, such as, for example, the receptacle shell 12 can include at least one rib and the plug shell 14 can include at least one groove.

The plug shell 14 has a first end 40 and a second end 42. In the embodiment shown, the at least one alignment projection or member 38 extends from at and/or near the first end 40 toward the second end 42. An attachment portion 44 can be positioned at and/or near the second end 42. The attachment portion or flexible insert-receiving retention portion 44 is provided and configured to attach the plug shell 14 to the insert 24, as will be more fully described. One or more retention projections 45 extend into an insert-receiving opening 47. The plug shell 14 includes a flange 46 intermediate the first end 40 and the second end 42.

The coupling ring 16 has a first end 50 and a second end 52. An internally threaded portion 54 extends from at and/or near the first end 50 toward the second end 52. The internal threads 54 can threadably engage the external threads 34 on the receptacle shell 12, for example, to draw the plug shell 14 toward the receptacle shell 12. In various instances, the coupling ring 16 can include a textured surface or gripping surface 56, which can facilitate rotation of the coupling ring 16. For example, the textured surface 56 can be positioned around the outer surface of the coupling ring 16. An engagement portion 58 is provided proximate the second end 52 of the coupling ring 16.

In various illustrative embodiments, components of the circular connector assembly 10 can be comprised of composite material or plastic material(s). In various embodiments, one or more of the receptacle shell 12, the plug shell 14 and/or the coupling ring 16 can be comprised partially or entirely of composite or plastic material(s). While components of the circular connector assembly 10 can be comprised of composite or plastic material(s), the electrical terminals housed within the receptacle shell 12 and plug shell 14 can comprise metallic and/or electrically conductive material(s).

Plastic materials can include thermoplastic materials. In certain instances, the various components of the circular connector assembly 10 can be comprised of different plastic materials and/or varying compositions of the same plastic materials. In other instances, the various components of the circular connector assembly 10 can be comprised of the same plastic materials and, in some instances, the various components of the circular connector assembly 10 can be comprised of the same compositions of the same plastic materials, for example.

Figure 4C:
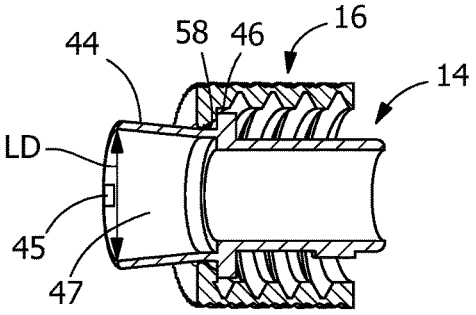
FIG. 4C is a cross-sectional view illustrating the installation of the coupling ring on the plug shell of the circular connector assembly, the coupling ring is shown fully inserted beyond the flexible retention portion, allowing the flexible retention portion to be returned to an uncompressed position.
Figure 4B:
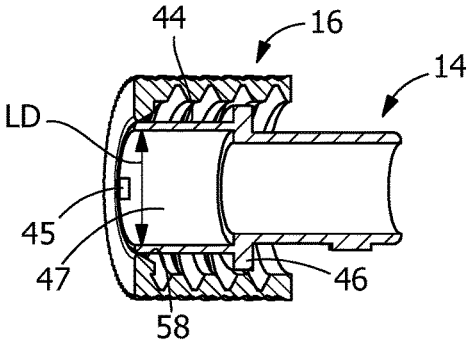
FIG. 4B is a cross-sectional view illustrating the installation of the coupling ring on the plug shell of the circular connector assembly, the coupling ring is shown at the start of the installation, in which the flexible retention portion is compressed.
Figure 4A:
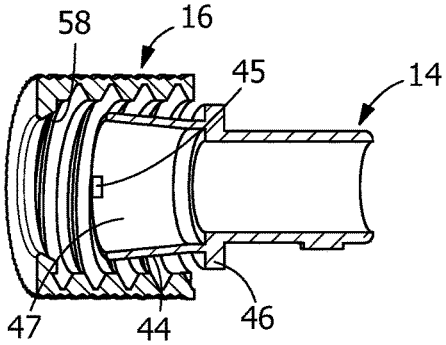
FIG. 4A is a cross-sectional view illustrating the installation of the coupling ring on the plug shell of the circular connector assembly, the coupling ring is shown prior to installation.

Referring to FIGS. 4A, 4B and 4C, the insertion of the coupling ring 16 onto the plug shell 14 is shown. As shown in FIG. 4A, prior to the insertion of the coupling ring 16 onto the plug shell 14 and over the flange 46, the flexible insert-receiving retention portion 44 and the insert-receiving opening 47 have a generally oval configuration. In this position, the short diameter SD of the insert-receiving opening 47 is smaller than the diameter of a circular opening in the engagement portion 58 of the coupling ring 16. The long diameter LD of the insert-receiving opening 47 is larger than the diameter of the circular opening in the engagement portion 58 of the coupling ring 16.

As the coupling ring 16 is rotated and inserted over the flange 46 of the plug shell 14, the engagement portion 58 of the coupling ring 16 engages the flexible insert-receiving retention portion 44, as shown in FIG. 4B. The engagement of the engagement portion 58 with the flexible insert-receiving retention portion 44 causes the flexible insert-receiving retention portion 44 to resiliently deform and conform to the shape of the circular opening in the engagement portion 58. The circular shape of the flexible insert-receiving retention portion 44 causes the short diameter SD of the insert-receiving opening 47 and the long diameter LD of the insert-receiving opening 47 to be equal. In this position, the short diameter SD and the long diameter LD are equal to the diameter of the circular opening in the engagement portion 58 of the coupling ring 16, thereby allowing the engagement portion 58 of the coupling ring 16 to be inserted over the flexible insert-receiving retention portion 44.

With the coupling ring 16 inserted onto the flexible insert-receiving retention portion 44, the rotation and insertion of the coupling ring 16 is continued to the position shown in FIG. 4C. As this occurs, the engagement portion 58 moves proximate the flange 46. As the coupling ring 16 advances toward the flange 46, the engagement portion 58 moves beyond the flexible insert-receiving retention portion 44, allowing the flexible insert-receiving retention portion 44 to return to its unstressed, uncompressed or undeformed oval shape in which the short diameter SD of the insert-receiving opening 47 is smaller than the diameter of the diameter of the circular opening in the engagement portion 58 of the coupling ring 16 and the long diameter LD of the insert-receiving opening 47 is larger than the diameter of a circular opening in the engagement portion 58 of the coupling ring 16.

Figure 5C:
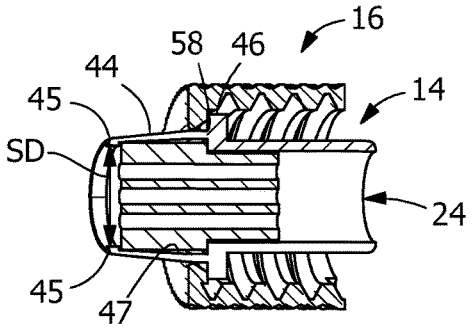
FIG. 5C is a cross-sectional view illustrating the installation of the insert into the plug shell of the circular connector assembly, the coupling ring is returned and shown in the installed position in which the coupling ring does not compress the flexible retention portion, such that the flexible retention portion prohibits the unwanted removal of the insert from the plug shell of the circular connector assembly.
Figure 5B:
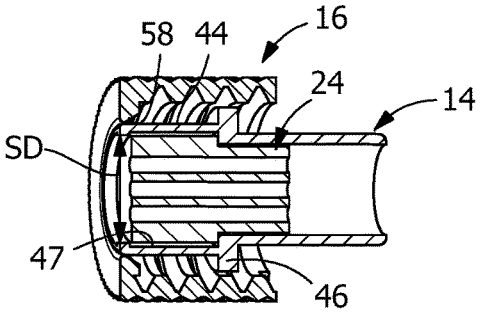
FIG. 5B is a cross-sectional view illustrating the installation of the insert into the plug shell of the circular connector assembly, the coupling ring is shown in cooperation with the flexible retention portion, compressing the flexible retention portion to allow the insert to be installed or inserted into the plug shell.
Figure 5A:
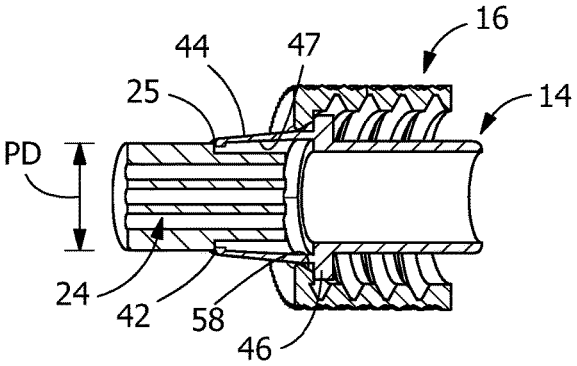
FIG. 5A is a cross-sectional view illustrating the installation of an insert into the plug shell of the circular connector assembly, the insert is shown prior to installation and the coupling ring is shown in an installed position in which the coupling ring does not compress the flexible retention portion.

Referring to FIGS. 5A, 5B and 5C, the operation of the coupling ring 16 relative to the flexible insert-receiving retention portion 44 of the plug shell 14 to allow for the insertion of the insert 24 is shown. As shown in FIG. 5A, the coupling ring 16 is positioned proximate the flange 46, allowing the flexible insert-receiving retention portion 44 to maintain the oval shape in which the short diameter SD of the insert-receiving opening 47 is smaller than the diameter PD of the insert 24 which is to be inserted therein and the long diameter LD of the insert-receiving opening 47 is larger than the diameter PD of the insert 24. Consequently, when the flexible insert-receiving retention portion 44 and coupling ring 16 are in the position shown in FIG. 5A, the insertion of the insert 24 into the insert-receiving opening 47 is prevented, as surfaces or walls 25 of the insert 24 will abut with end surfaces of the second end 42 of the flexible insert-receiving retention portion 44 proximate the short diameter SD of the insert-receiving opening 47.

As the coupling ring 16 is rotated to the position shown in FIG. 5B, the engagement portion 58 of the coupling ring 16 engages the flexible insert-receiving retention portion 44. The engagement of the engagement portion 58 with the flexible insert-receiving retention portion 44 causes the flexible insert-receiving retention portion 44 to resiliently deform and conform to the shape of the circular opening in the engagement portion 58. The circular shape of the flexible insert-receiving retention portion 44 causes the short diameter SD of the insert-receiving opening 47 and the long diameter LD of the insert-receiving opening 47 to be equal. In this position, the short diameter SD and the long diameter LD are larger than the diameter PD of the insert 24, thereby allowing the insert 24 to be inserted into and through the insert-receiving opening 47.

With the insert 24 properly inserted, as shown in FIG. 5C, the coupling ring 16 is rotated and returned to a position proximate the flange 46, whereby the engagement portion 58 moves proximate the flange 46. As the coupling ring 16 advances toward the flange 46, the engagement portion 58 moves beyond the flexible insert-receiving retention portion 44, allowing the flexible insert-receiving retention portion 44 to return to its undeformed oval shape in which the short diameter SD of the insert-receiving opening 47 is smaller than the diameter PD of the insert 24 and the long diameter LD of the insert-receiving opening 47 is larger than the diameter PD of the insert 24. Consequently, the removal of the circular insert 24 from the insert-receiving opening 47 is prevented, as the walls of the insert 24 will abut with surfaces or walls of the flexible insert-receiving retention portion 44 proximate the short diameter SD of the insert-receiving opening 47. In addition, the retention projections 45 engage surfaces of the insert 24 to prevent the removal of the insert 24 from the insert-receiving opening 47.

While FIGS. 4 and 5 show the movement of the flexible insert-receiving retention portion 44, the same type of movement occurs as the receptacle insert 22 is inserted into the flexible insert-receiving retention portion 36 of the receptacle shell 12. In the illustrative embodiment shown, the movement of the flexible insert-receiving retention portion 36 is not activated by a coupling ring, but rather a tool (not shown) is used which deforms the flexible insert-receiving retention portion 36 in a manner similar to that described above.

An illustrative method for retaining components, such as, but not limited to, an insert in a plug shell of a circular connector assembly includes positioning a coupling ring on the plug shell of the circular connector assembly, the plug shell of the circular connector having a flexible retention portion which is initially configured to not allow insertion of a housing therein. Moving the coupling ring from a first position to a second position in which the coupling ring engages the flexible retention portion of the plug shell. Deforming the flexible retention portion of the plug shell as the coupling ring is moved to the second position to a configuration in which the flexible retention portion accepts the housing therein. Returning the coupling ring to the first position. Allowing the flexible retention portion to return to an undeformed configuration as the coupling ring is moved to the first position, wherein the insert is retained in the flexible retention portion.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A circular connector assembly comprising:

a plug shell having a first flexible insert-receiving retention portion and a flange provided proximate the flexible insert-receiving retention portion, the flexible insert-receiving retention portion having a first insert-receiving opening, the first insert-receiving opening having an oval configuration at a free end thereof with a short diameter and a long diameter;

a coupling ring having an internal threaded portion and an engagement portion with a circular opening, the internal threaded portion configured to cooperate with the flange, the circular opening having a contact opening diameter which is larger than the short diameter of the first insert-receiving opening and smaller than the large diameter of the first insert-receiving opening;

the engagement portion dimensioned to resiliently deform the flexible insert-receiving retention portion when the engagement portion is provided in contact with the flexible insert-receiving retention portion;

wherein the engagement of the engagement portion with the flexible insert-receiving retention portion causes the short diameter of the first insert-receiving opening and the long diameter of the first insert-receiving opening to be equal and conform to the shape of the circular opening in the engagement portion.

2. The circular connector assembly as recited in claim 1, wherein the insert-receiving opening of the flexible insert-receiving retention portion has projections which extend into the insert-receiving opening.

3. The circular connector assembly as recited in claim 1, wherein an alignment member is provided on the plug shell.

4. The circular connector assembly as recited in claim 1, wherein a receptacle shell is provided and cooperates with the plug shell when the circular connector assembly is fully mated.

5. The circular connector assembly as recited in claim 4, wherein the receptacle shell has an externally threaded portion is positioned proximate an end of the receptacle shell.

6. The circular connector assembly as recited in claim 4, wherein the receptacle shell has a second flexible insert-receiving retention portion with a second insert-receiving opening dimensioned to receive a receptacle shell insert.

7. A circular connector assembly comprising:

a receptacle shell having an externally threaded portion positioned proximate a first end of the receptacle shell and a first flexible insert-receiving retention portion with a first receiving opening;

a plug shell having a second flexible insert-receiving retention portion and a flange provided proximate the second flexible insert-receiving retention portion, the second flexible insert-receiving retention portion having a second receiving opening, the second receiving opening having an oval configuration at a free end thereof with a short diameter and a long diameter;

a coupling ring having an internal threaded portion and an engagement portion with a circular opening, the internal threaded portion configured to cooperate with the flange and the externally threaded portion, the circular opening having a contact opening diameter which is larger than the short diameter of the second receiving opening and smaller than the large diameter of the second receiving opening;

the engagement portion dimensioned to resiliently deform the second flexible insert-receiving retention portion when the engagement portion is provided in contact with the second flexible insert-receiving retention portion;

a housing which is inserted into and maintained in the second receiving opening by the second flexible receiving retention portion;

wherein the engagement of the engagement portion with the second flexible insert-receiving retention portion causes the short diameter of the second receiving opening and the long diameter of the second receiving opening to be equal and conform to the shape of the circular opening in the engagement portion.

8. The circular connector assembly as recited in claim 7, wherein the housing has a circular second diameter which is less than the circular engagement portion diameter.

9. The circular connector assembly as recited in claim 8, wherein the first receiving opening of the first flexible insert-receiving retention portion has generally oval configuration at a free end thereof, the oval configuration of the first receiving opening of the first flexible insert-receiving retention portion having a first diameter and a second diameter.

10. The circular connector assembly as recited in claim 7, wherein the second flexible insert-receiving opening of the second flexible insert-receiving retention portion has first projections which extend into the second receiving opening.

11. The circular connector assembly as recited in claim 10, wherein the first receiving opening of the first flexible insert-receiving retention portion has second projections which extend into the first receiving opening.

12. A method for retaining components in a circular connector assembly, the method comprising:

positioning a coupling ring on a plug shell of the circular connector assembly, the plug shell of the circular connector having a flexible retention portion which is initially configured to not allow insertion of a housing therein;

moving the coupling ring from a first position to a second position in which the coupling ring engages the flexible retention portion of the plug shell;

deforming the flexible retention portion of the plug shell as the coupling ring is moved to the second position to a configuration in which the flexible retention portion accepts the housing therein;

returning the coupling ring to the first position;

allowing the flexible retention portion to return to an undeformed configuration as the coupling ring is moved to the first position, wherein the housing is retained in the flexible retention portion.

13. The method as recited in claim 12, wherein the flexible retention portion is initially configured in an oval configuration.

14. The method as recited in claim 13, wherein the flexible retention portion is deformed to a circular configuration.

* * * * *